US006038988A

United States Patent [19]

Merz et al.

[11] Patent Number: 6,038,988

[45] Date of Patent: Mar. 21, 2000

[54] WASTE INCINERATING METHOD AND APPARATUS WITH COUNTER-CURRENT EXHAUST GAS FLOW

[75] Inventors: Albert Merz; Hubert Vogg, both of Karlsruhe; Roland Walter, Graben-Neudorf, all of Germany

[73] Assignee: Forschungszentrum Kalsruhe GmbH, Karlsruhe, Germany

[21] Appl. No.: 09/009,027

[22] Filed: Jan. 20, 1998

Related U.S. Application Data

[63] Continuation-in-part of application No. PCT/EP96/03198, Jul. 19, 1996.

[30] Foreign Application Priority Data

Jul. 20, 1995 [DE] Germany ..... 195 26 457

[51] Int. Cl.[7] ..... F23G 7/06; F23G 15/00; F23B 5/00; F23C 9/00; F23L 9/00

[52] U.S. Cl. ..... 110/346; 110/210; 110/211; 110/214; 110/235; 110/248; 110/297; 110/314; 110/348

[58] Field of Search ..... 110/210, 211, 110/214, 229, 230, 231, 235, 248, 255, 257, 297, 302, 305, 308, 314, 317, 318, 319, 336, 337, 346, 348

[56] References Cited

U.S. PATENT DOCUMENTS

| | | | |
|---|---|---|---|
| 1,229,320 | 6/1917 | Peckham | 110/318 |
| 1,232,138 | 9/1917 | Wells | 110/248 |
| 1,276,490 | 8/1918 | Casserly | 110/317 X |
| 1,402,843 | 6/1922 | Doherty | 110/317 X |
| 1,622,356 | 3/1927 | Spencer | 110/318 |
| 1,813,156 | 7/1931 | Gilchrist | 110/235 |
| 2,083,846 | 6/1937 | Hynd | 110/314 |
| 3,301,202 | 1/1967 | Brundin | 110/229 |
| 3,334,599 | 8/1967 | Tanner | 110/346 X |
| 3,808,986 | 5/1974 | Logdon . | |
| 4,380,228 | 4/1983 | Crowley | 110/214 X |
| 4,969,405 | 11/1990 | Goodrich | 110/235 X |
| 5,052,310 | 10/1991 | Goff et al. | 110/346 X |
| 5,564,348 | 10/1996 | Groschl et al. | 110/235 |

FOREIGN PATENT DOCUMENTS

| | | | |
|---|---|---|---|
| 0 304 712 A2 | 3/1989 | European Pat. Off. | 110/214 |
| 0 497 089 | 8/1992 | European Pat. Off. . | |
| 1 526 078 | 2/1970 | Germany . | |
| 33 45 867 A1 | 6/1985 | Germany | 110/346 |
| 42 19 231 | 10/1993 | Germany . | |
| 59-044513 | 3/1984 | Japan . | |
| 2-101312 | 4/1990 | Japan | 110/346 |
| 5-223225 | 8/1993 | Japan | 110/235 |
| 5-272735 | 10/1993 | Japan | 110/235 |
| 94/15148 | 7/1994 | WIPO | 110/317 |

OTHER PUBLICATIONS

A. Merz et al., "Industrial Furnaces and Boilers; Proceedings of the 3rd European Conference", Apr. 18–21, 1995, Lisbon, Portugal,pp. 454–466.

Hubert Vogg et al., "Primare NOx–Minderung—Der Schlussel Für Eine Kostengguenstige Abfallverbrennerungstechnologie", *Chemie Ingenieur. Technik.*, Bd. 68, Nr. 1/2,Feb. 1996, Weinheim, Germany.

*Primary Examiner*—James C. Yeung
*Assistant Examiner*—Ljiljana V. Ciric
*Attorney, Agent, or Firm*—Klaus J. Bach

[57] ABSTRACT

In a method of incinerating waste material in a parallel flow process wherein hot exhaust gases are conducted above a combustion chamber grate in the same direction as the material is moved on the grate, different temperatures zones are maintained to which air is admitted from the bottom through the grate such that a temperature of less than 900° C. is maintained in a first zone which is a drying zone, a temperature of about 1000° C. is maintained in a second zone which is an evaporization and vaporizing zone, a temperature of about 900° C. is maintained to in a third zone, which is the final combustion zone and a temperature less than 900° C. is maintained in a fourth zone which is a sintering zone. Additional air is supplied to the combustion zones 1 through the side walls of the combustion chamber. A dividing wall is disposed above the grate over which the hot combustion gases are conducted to a discharge opening so that heat is transferred to the dividing wall for radiation back onto the waste material on the grate.

9 Claims, 4 Drawing Sheets

| Combustion Chamber I | Combustion Chamber II | Enveloping Air | $\dot{m}_{Br}$ [ kg/h ] | $O_2$ [ % ] | NO [ mg/Nm$^3$] | NO/$\dot{m}_{Br}$ [ mg/kg ] |
|---|---|---|---|---|---|---|
| ● | ■ | without | 171 | 9.0 | 172 | (725) |
| ○ | □ | with | 171 | 10.8 | 55 | 280 |

WASTE INCINERATING METHOD AND APPARATUS WITH COUNTER-CURRENT EXHAUST GAS FLOW

This is a Continuation-in-Part application of international patent application PCT/EP96/03198 filed Jul. 19, 1996, and claiming the priority of German Patent Application 195 26 457.6 filed Jul. 20, 1995.

BACKGROUND OF THE INVENTION

The present invention resides in a method of incinerating waste material which needs to be treated thermally, such as garbage, on a grate of an incineration apparatus wherein, for performing the method in accordance with the principle of parallel flow heating, primary air is admitted to the grate from below to a combustion chamber.

Thermal treatment of waste material is important in the framework in the concept of integrated waste material economics. However, waste material is still burnt with a relatively large amount of excess air. More than 3 $Nm^3$ air are required per kg of combustible material with a heat content of about 8 MJ/Kg. Actually, 6 $Nm^3$ have been used until not long ago. By this time, the specific air use number has been reduced to about 5 $Nm^3$.

Cost efficient waste material incineration plants have not been developed since, up to this date, no processes have become available which would prevent the formation of $NO_x$ at the primary combustion site to such a degree that no exhaust gas cleaning equipment is required in the exhaust gas flue which does not need any means for reducing the $NO_x$ emissions. Although there is a limit value of 200 mg $NO_x/Nm^3$ for the combustion of waste materials the public expects the $NO_x$ emission values to be less than half that amount. Consequently, the design target to be achieved for the primary side $NO_x$ emission reduction is 100 $mg/Nm^3$.

U.S. Pat. No. 3,808,986 discloses an apparatus for the incineration of waste material. The purpose and the design for this apparatus are to increase the combustion temperatures in order to reduce the amount of the components which can normally not be burned. This leads to exhaust gas temperatures of much over 1000° C. and consequently to the formation of relatively large amounts of $NO_x$ in the exhaust gas. This however is not acceptable with the ever stricter exhaust gas quality requirements. Other apparatus known in the art which operate in a center- and counter current flow fashion generally have high $NO_x$ emission values in the range of 200 to over 400 $mg/Nm^3$.

Further incineration processes and apparatus using a parallel flow principle for the combustion of waste materials are known from DE 42 19 231 C1 and from Thome-Kozmiensky: Thermische Abfallbehandlung, Berlin, EF Verlag für Energie-und Umwelttechnik, 1994, pages 160 to 163. In this process wherein secondary air is supplied to the combustion chamber from the top, a temperature profile is generated in the combustion zone above the grate which provides for uniformly increasing temperatures of from 700° C. at the beginning of the grate to 1300° C. at the end of the combustion zone ahead of the combustion gas exhaust downstream of the combustion chamber area. Such an arrangement however also leads to undesirably high $NO_x$ emission values which was not recognized and generates a problem that has not been addressed by those designs.

It is therefore the object of the present invention to provide a method with which the $NO_x$ content in the exhaust gas of such incinerators is reduced purely by measures to the combustion chambers. The invention is based on the understanding that this can be achieved with a temperature reduction to below 900° C. at the end of the combustion chamber where the exhaust gas leaves the combustion chamber. Even such an object is novel.

SUMMARY OF THE INVENTION

In a method of incinerating waste material in a parallel flow process wherein hot exhaust gases are conducted above a combustion chamber grate in the same direction as the material is moved on the grate, different temperature zones are maintained on the grate to which air is admitted from the bottom through the grate such that a temperature of less than 900° C. is maintained in a first zone which is a drying zone, a temperature of about 1000° C. is maintained in a second zone which is an evaporization and vaporization zone, a temperature of about 900° C. is maintained in a third zone, which is the final combustion zone and a temperature of less than 900° C. is maintained in a fourth zone which is a sintering zone. Additional air is supplied to some of the combustion zones through the side walls of the combustion chamber. A dividing wall is disposed above the grate and the hot combustion gases are conducted to a discharge opening over the dividing wall to which heat is transferred in the process for radiation back onto the waste material on the grate.

With the method according to the invention to thermal $NO_x$ formation at the end of the combustion process can be prevented by combustion chamber design measures resulting in a reduction of the the exhaust gas temperature from zone to zone. Not only is the specific combustion chamber air volume reduced, but the combustion gas temperature at the exhaust end is substantially below 900° C. whereby $NO_x$ formation is relatively low. There is no need for an admission of secondary air for after-burning which would increase the exhaust gas temperature. It is important that with the method and apparatus according to the invention a controlled temperature field or profile is obtained that is generated within the combustion chamber.

The exhaust gas is maintained by special building components within the combustion chamber in temperature ranges exactly controlled by the addition of supplemental air. The exhaust gas flows in parallel with the movement of the solid material on the grate through the zones at the end of which it is deflected upwardly and then again flows back over the building components in a direction opposite to the gas flow over the grate. With the guided flow pattern of the exhaust gases, the combustion chamber building components assume the temperature of the exhaust gases and act as infrared radiation emitters similar to the way such radiation is provided by the hot exhaust gas body present in a counter-current combustion process over the drying zone. The combustion conditions in the present parallel flow configuration are the same as those in a counter-current incinerator without its disadvantages that is without-the need for additional $NO_x$ removal measures. With the method and apparatus according to the invention, the advantages of both combustion processes are combined in an advantageous manner.

Details of the method will be described below on the basis of the accompanying drawings.

DESCRIPTION OF A PREFERRED EMBODIMENT

Figure 1:
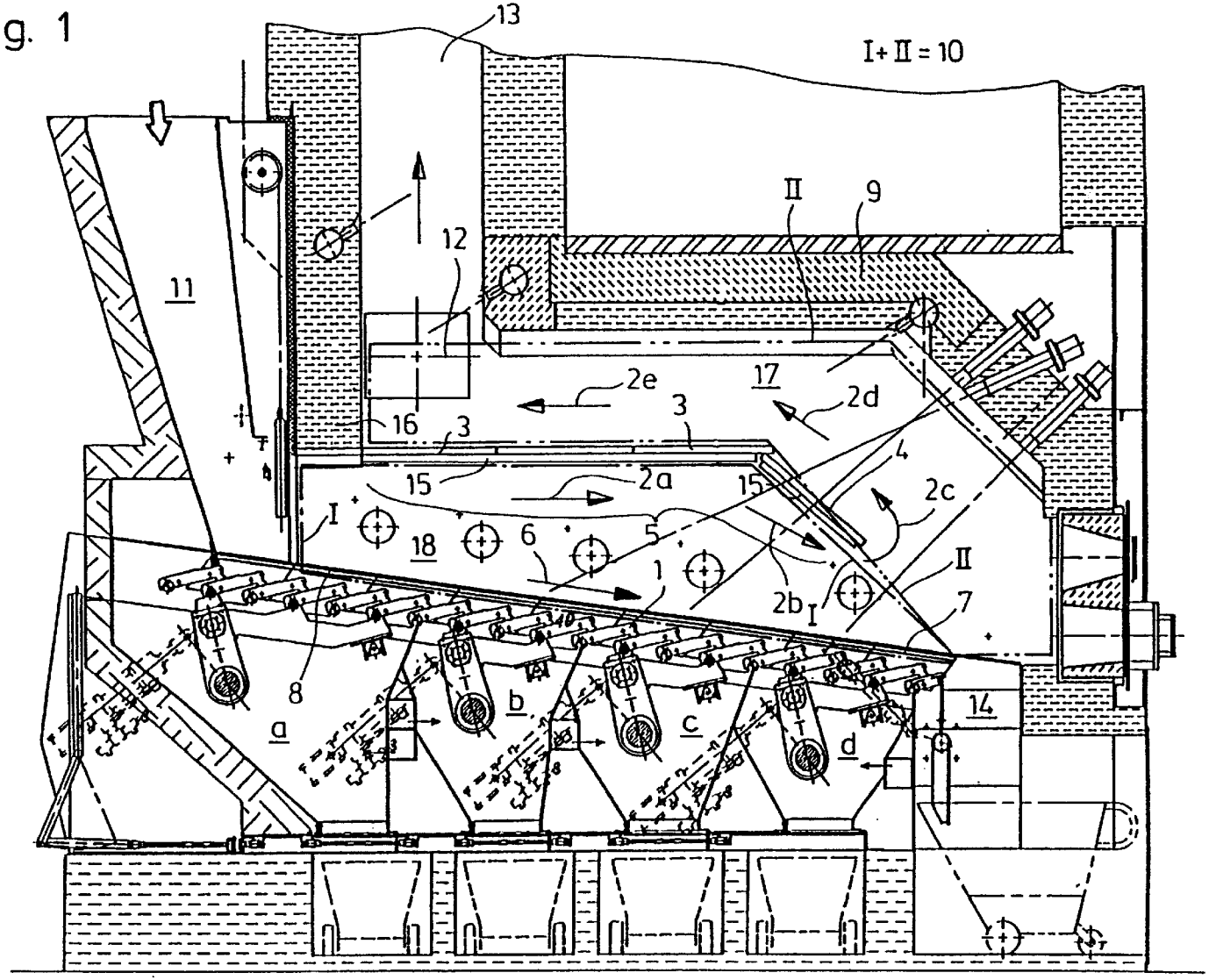
FIG. 1 is a cross-sectional view showing schematically a waste incineration apparatus.

FIG. 1 shows schematically an embodiment of an incineration apparatus wherein waste is burnt on a grate in a parallel flow combustion principle. The primary air is supplied to the grate from the bottom that is from the under-flow zones a to d. The hot exhaust gas 2*a*–2*e* is conducted, in parallel flow with the solid material flow on the grate 1, above the grate 1 in the combustion direction 6. The exhaust gas is guided by components 3, 4 which are ceramic plates which may have the same length as the combustion zone 5 of the primary area I and which will be described in detail later. The combustion occurs in subsequent zones which have accurately defined temperatures as will be described in detail later on the basis of FIGS. 2 and 3. Subsequently, the hot exhaust gas is deflected upwardly around the end portion of the ceramic plate and 4 into the secondary area II and, in a countercurrent flow 2*d*, 2*e* above the components 3, 4. In the apparatus shown in FIG. 1, the counter current flow extends over the combustion zone back essentially to the waste material entrance area 8 before it is discharged through the exhaust opening 12. As a result, the heat of the exhaust gases is transferred to the components 3, 4 and is radiated therefrom toward the grate 1 over the full length of the components 3, 4, whereby the heat is transferred to the material on the grate 1 and, consequently, is utilized. A shorter heat transmission length over only a part of the components is possible by arranging the exhaust opening at a different location.

Figure 2:
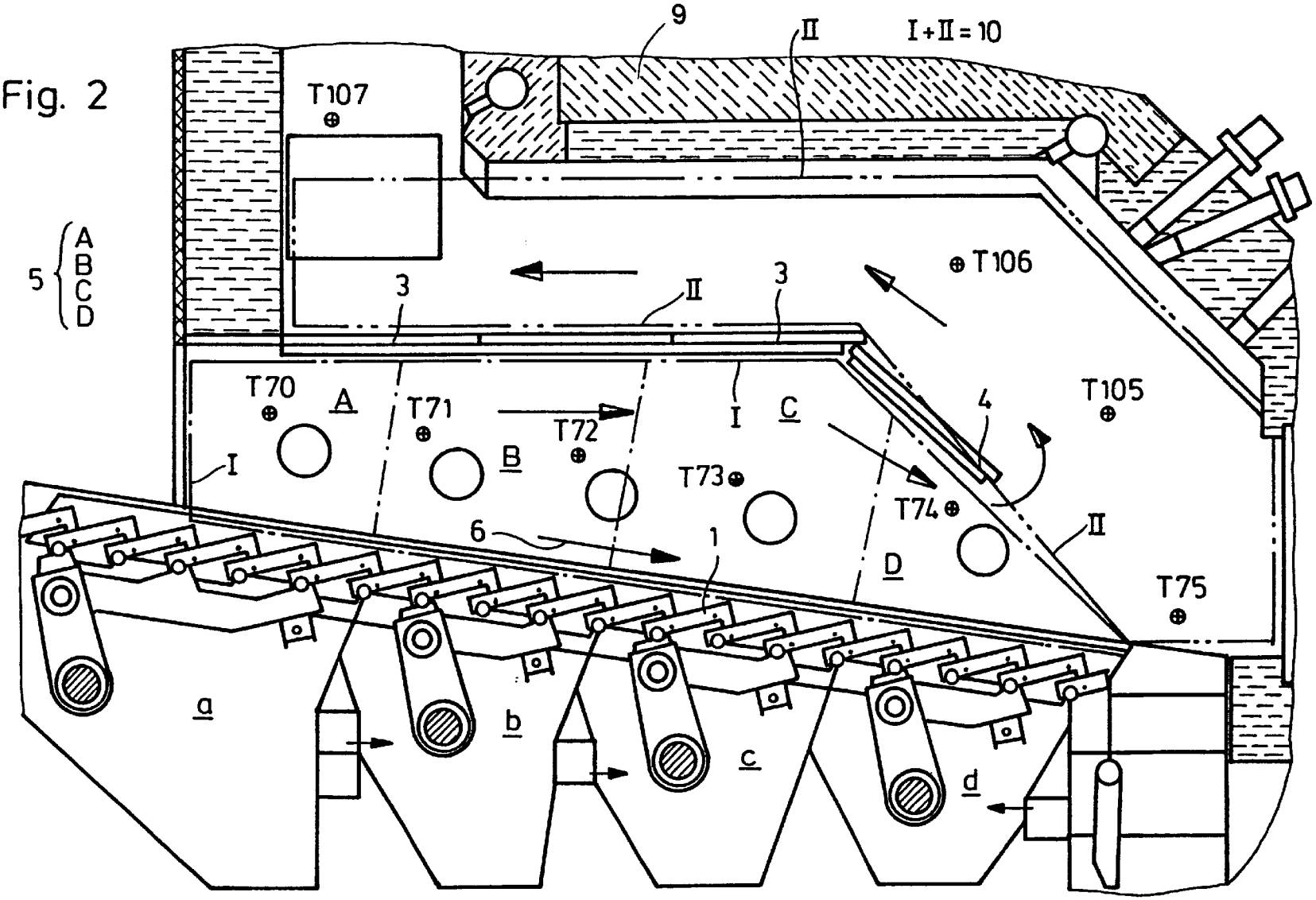
FIG. 2 is an enlarged cross-sectional view of the combustion chamber area of the apparatus shown in FIG. 1.

The central element of a waste incineration apparatus in which the method is performed is the combustion chamber 10, which consists of the primary area I and the secondary area II and is delineated at its top by a heat insulating wall 9 as shown in the enlarged view of FIG. 2. The detail features shown in FIG. 2 are the same as those shown in FIG. 1. The same components are therefore designated by the same reference numerals even if they are not specifically given. In the lower part of the primary area I, there is the incineration grate 1 above which there is the combustion zone 5 comprising individual zones as indicated in FIG. 2. The combustion of the material supplied through the waste material chute 11 at the beginning 8 of the grate 1 occurs by parallel flow combustion wherein the material to be burnt moves in the combustion direction 6, that is, along with the combustion, to an ash discharge end 14. The combustion gases 2 formed in the combustion process flow in the direction of the arrows 2*a* to 2*e* in the secondary area II from the combustion zone 5 to the discharge opening 12 into the flue 13. In the exemplary apparatus as shown in FIG. 1, the discharge opening 12 is disposed—as seen in the direction of the combustion 6—about above the beginning of the combustion zone 5 on top of the grate 1 in the upper wall 9 of the combustion chamber 10 downstream of the secondary area II and leads to the flue 13 disposed thereabove. However, the discharge opening 12 may be arranged in the area II further toward the front when seen against the direction of combustion.

Preferably, a heat conductive and heat storing intermediate wall is disposed above the grate 1 below the top wall 9 of the combustion chamber 10. The intermediate wall has about the same length as the combustion zone 5 and consists of individual ceramic plates 3 and 4 arranged one after the other and supported on ledges 15 (FIG. 1) formed on the side walls 17 of the combustion chamber 10. The intermediate wall separates the primary area I from the secondary area II. The last ceramic plate 4 in the direction of combustion 6—is inclined toward the grate 1. The intermediate ceramic plates 3, 4 are sealed tightly between the side walls 17 and the front wall 16 of the combustion chamber 10 and extends in the direction of combustion 6,—about up to the end 7 of the grate 1 or the combustion zone 5. The lower part of the side walls 17, which limits the primary area I or respectively, the combustion zone 5, is designated by the reference numeral 18.

Behind the intermediate wall 3, 4, again as viewed in the direction of combustion 6, there is the flow reversal area 2*c* for reversing the flow direction of the exhaust gases 2*a*, 2*b* From here the combustion gases flow in the opposite direction 2*d* and 2*e* over the intermediate wall 3, 4 to the discharge opening 12. Above the intermediate wall 3, 4 beginning already in the flow reversal area 2*c* is the secondary area II. The plates 3, 4 consist for example of an aluminum oxide ceramic material and have, with a grate width of 80 cm, a thickness of 25 to 35 mm. They are highly heat conductive and reflective to provide good heat transfer through the plates from the exhaust gas area 2*d*, 2*e*, and, by heat radiation back to the combustion zone 5.

With the method according to the invention, the combustion in the primary area I takes place in four subsequent zones A, B, C, and D, which are disposed above the respective air supply zones a, b, c and d below the grate 1 as shown in FIG. 2. There are three mechanisms by which $NO_x$ is formed:

1. From the nitrogen contained in the waste fuel; generally the waste material includes about 1% nitrogen in chemical compounds
2. $NO_x$ is promptly formed with the nitrogen in the combustion air,
3. Thermal $NO_x$ is formed as under 2, by nitrogen in the air in the exhaust gas flow after leaving the combustion chamber at high temperatures and the formation of flames. The method, according to the invention is concerned mainly with this type of $NO_x$ formation, that is, the method attempts to keep the exhaust gas temperatures in that area low.

To this end, the temperatures in the various zones A, B, C and D are controlled in a quite special way as shown by the graph of FIG. 3:

In a first zone A of the combustion chamber 10 above the grate 1, that is the drying and pyralysis zone of the waste material in the primary area I, an average temperature of less that 900° C. is maintained.

In a second zone B, the degasification and gasification zone of the fuel, a controlled average temperature in the range of maximally 1000° C. is maintained which is higher than that maintained in the zone A.

It is important that, afterwards in a third zone C, the burning zone of the waste material, a temperature is maintained, which is again lower than the temperature maintained in the zone B, that is, it is in the range of 950° C. down to below (860° C.) whereas then, in a fourth zone D, the sinter zone, the temperature is still lower, that is, it is in the range from below (860° C.) to (680° C.)

This means that the temperature generally decreases in the flow direction of the gases above the waste material bed. The desired temperature profiles are achieved by admitting the combustion air selectively by zones from the zones a, b, c, and d below the grate through the grate and controlling the combustion air flow volume for the zones A and B in such a way that the combustion in the fuel material bed is in an under stoichiometric range. Because of an insufficient oxygen supply during combustion on the primary side, substantial amounts of CO are generated by the material in this area, that is, CO amounts of 100 g/Nm$^3$ are generated. The CO acts as reducing agent with regard to the $NO_x$ already formed, whereby elemental nitrogen is generated. In addition, a multitude of radical reactions may take place which may have an influence on the $NO_x$ reduction. The under-stoichiometric combustion can be controlled selectively by increasing waste material or fuel addition or the throttling of the combustion air permitted to flow through the respective zones.

Furthermore, additional air is supplied to the combustion chamber 10 through the side wall or walls, mainly in the zones A and B below the installation components 3 and 4, that is, into the combustion chamber above the grate 1. This additional air is called enveloping air 20. It has a lower or about the same temperature as the combustion chamber temperature. This additional air forms on air envelope in the side wall area. The enveloping air promotes the gas phase reactions in the zones A and B. It is important however, that in the area above the installation components 3 and 4 in the secondary area, that is after the fourth zone D, no additional secondary air is admitted.

Figure 4:
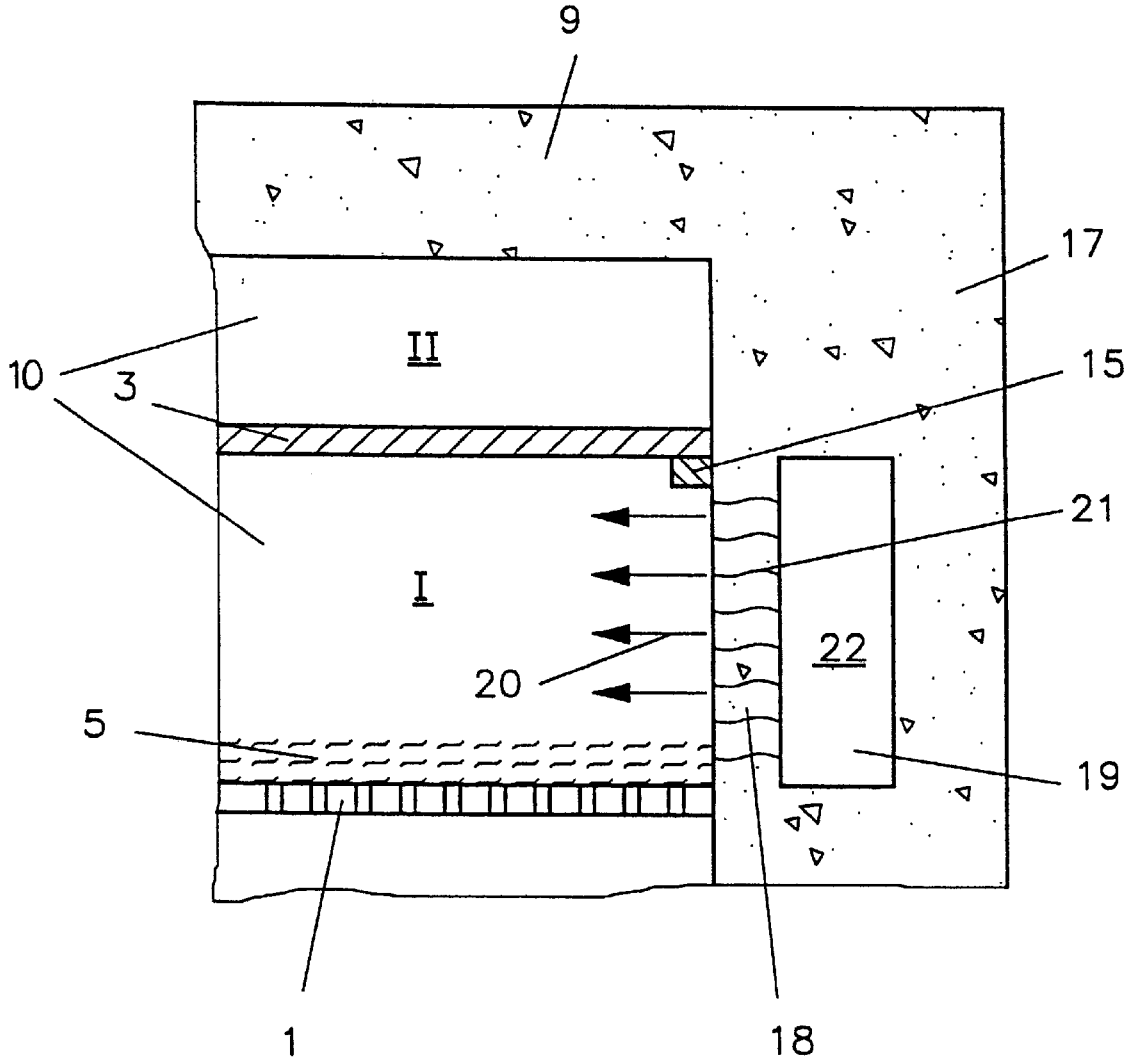
FIG. 4 is a cross-sectional view of the side wall of the combustion chamber in the primary combustion area I of FIGS. 1 and 2.

For an explanation of the addition of the enveloping air 20, FIG. 4 shows, in a cross-sectional view, a side wall of the apparatus, the cross-section being taken at the level of the combustion chamber 10. The side wall 17 includes a cooling air channel 19 through which cooling air 22 is conducted, pressurized by means of a blower which is not shown, in parallel to the combustion direction 6 for cooling the side walls. In a partial area 18 (FIGS. 1, 4) adjacent the primary area I and the channel 19, the side wall 17 is porous so that enveloping air 20 from the channel 19 can pass into the primary area I. The air passages may be formed by porosity, small channels or other passages 21. The partial area 18 of the side wall 17 with the porosity or the passages is preferably disposed mainly in the area of the zones A and B.

By providing a predetermined porosity for air and/or by a variation of the cooling air pressure, the amount of enveloping air 20 can be controlled as desirable. The temperature of the enveloping air depends on how much it is heated within the wall.

The primary area I is delimited at the bottom by the grate 1 and at the top by the ceramic plate installations 3 and 4 and toward the sides by the lower side walls 18 consisting of a fire brick lining. In the primary area I, the side wall 18 is—as already described—air permeable to permit the enveloping air 20 to pass. The air permeability can be achieved by a predetermined uniform and adjustable air passage rate of the wall itself or certain wall parts. This is particularly advantageous for the arrangement described above wherein the enveloping air 20 as supplied through the cooling passages 22 in the side wall 17. However, the enveloping air 20 can be supplied by other sources through particular or several openings in the wall.

Figures 3A, 3B:
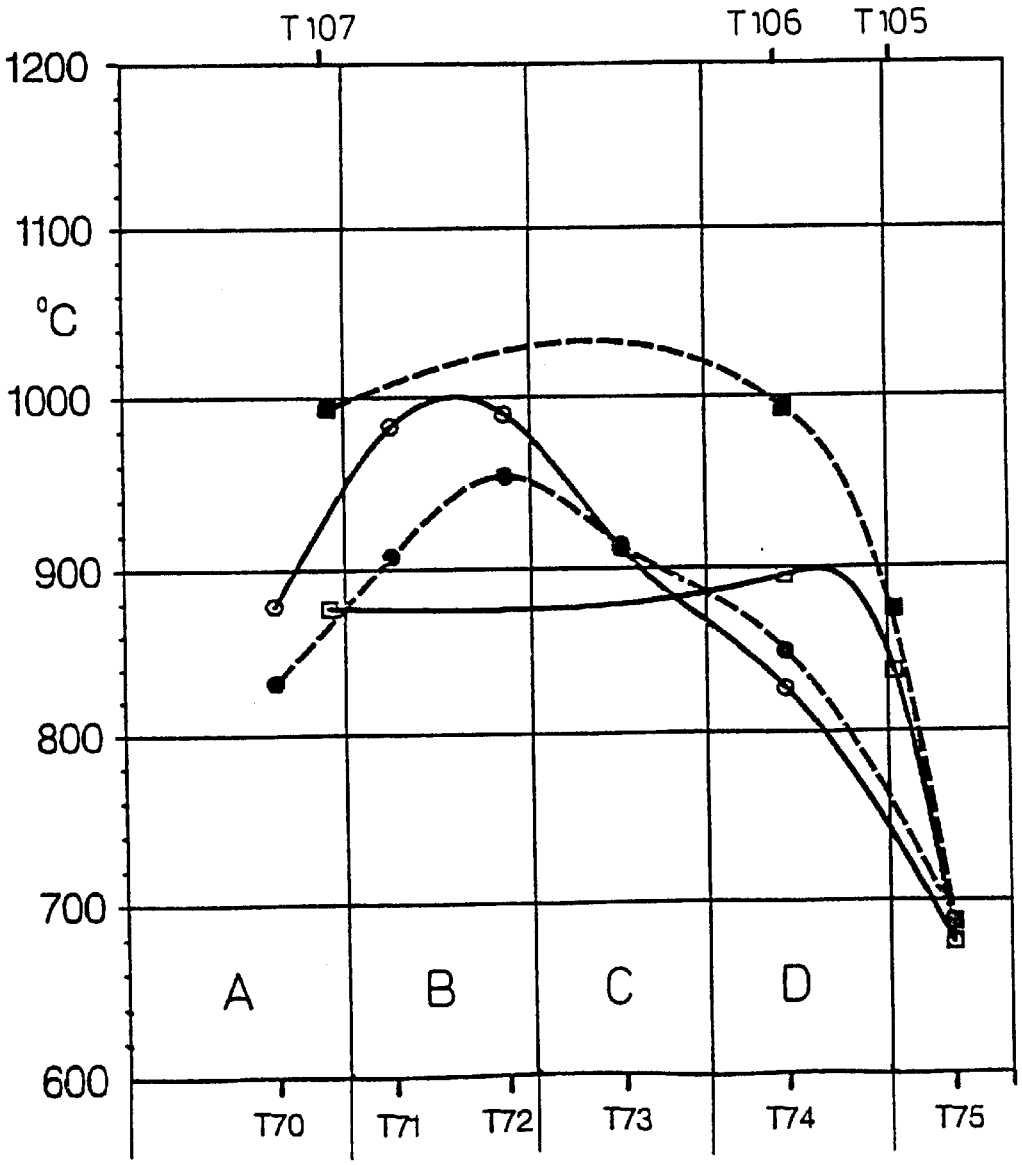
FIG. 3 is a graphic representation of the temperature pattern obtained with the method according to the invention in the combustion chamber.

FIG. 3B shows graphically the temperature in the various zones and FIG. 3A gives certain characteristic values of the combustion process. The values are actual values determined during tests in a waste material incineration plant. The curves with the round measuring points show the temperatures in the primary area I that is in the zones A, B C, and D at the measuring points T70 to T75 and the curves with the square measuring points indicate the temperatures in the exhaust gas tract at the measuring points T105–T107. The solid measuring points show the temperatures without addition of the enveloping air 20 and the empty points show the temperature values as desirable in accordance with the invention with the addition of enveloping air 20. The curves clearly show that the desired temperature reduction in the rear zones C and D is being achieved. In this connection, volume ratios of enveloping air to primary air of ⅕ to ⅙ (that is, 14–17% enveloping air participation in the total air supply) with the combustion temperatures shown and enveloping air temperatures of about 500° C. to 750° C. have been found to be particularly advantageous.

In the zones A, B, C and D of the primary area I all the processes such as drying, degasifying, gasifying, sinter reactions and gas phase reactions occur above the material bed. In the tests given in FIGS. 3A and 3B the primary air addition was controlled in stages from the zones a, b, c, and d below the grate. With a fuel material consumption of about 170 kg/h, the primary air addition was 100 Nm$^3$/h each in zone A and D, and 200 Nm$^3$/h in each of zones B and C. To support the gas phase reaction in zones A and B above the material bed on the grid 1, the enveloping air is admitted to the combustion chamber along the limiting side walls 18 at the rate of 100–120 Nm$^3$/h. Because the enveloping air is admitted through passages in the hot side walls, the enveloping air is heated to the desired temperature of 500° C. to 750° C. by the time it enters the primary space I. In this range, the temperature can be adjusted by air flow control measures.

The secondary space II is immediately adjacent the primary space I. As already mentioned, no additional combustion air is admitted in the secondary space II. For the chemical reaction occurring in this space such as the remaining CO conversion, the oxygen supplied with the primary air and the enveloping air is sufficient.

During the tests with the apparatus described with parallel flow that is with the installation components 3 and 4 and with the addition of the enveloping air 20 from the side wall cooling system, a complete combustion with carbon monoxide values of less than 5 mg/Nm$^3$ were reached. With the special air addition in the zones A, B, C and D, the temperature distribution in the gas canal can be controlled as desired.

With the process according to the invention, the desired downstream temperatures of 870° C. to 930° C. can be achieved which results in an $NO_x$ reduction in the exhaust gas and, in addition, provides for a quite complete combustion of the exhaust gases.

Tests have shown the following results given in FIG. 3A:

Combustion without enveloping air: about 170 mg/Nm$^3$ $NO_x$ in the exhaust gas flow.

(temperature curve including solid points)

Combustion with enveloping air: about 55 mg/Nm$^3$ $NO_x$ in the exhaust gas flow.

In each case there was a mass flow in $m_{Br}$ of 171 kg/h and oxygen additions of 9.0 or respectively, 10.8%, each without equipment for the removal of nitrogen from the exhaust gases. As already mentioned apparatus based on the state of the art, which operate with center and counter current flows have generally high $NO_x$ emission values in the range of 200 to above 400 mg/Nm$^3$.

It has been shown accordingly with the new process that, simply with combustion chamber design measures, the emission limits expected to be mandated of substantially below 200 mg/Nm$^3$ can be more than with the method and the apparatus according to the invention without additional $NO_x$ removal from the exhaust gas in the exhaust system.

What is claimed is:

1. A method of incinerating waste material in a waste incinerator having a combustion chamber with different zones disposed between opposite side walls of the chamber, and a grate on which waste the material is moved through said combustion chamber and through which primary air is supplied from below grate to the waste material for combustion of the waste material in said zones to form hot combustion gases which are conducted both above the waste material on the grate in parallel flow with the movement of the waste material on said grate and below installation components disposed above the grate and which gases are then conducted above the installation components to a discharge opening in counter-current flow to the flow of said combustion gases above the grate, said method comprising the steps of:

maintaining, in a first zone of the combustion chamber above the grate, an average temperature of less than 900° C., maintaining, in a second zone adjacent said first zone, an average temperature of about 1000° C., maintaining, in a third zone adjacent said second zone, an average temperature which is between 950° C. and 860° C., and is thus lower than that in said second zone maintaining, in a fourth zone adjacent said third zone, a temperature of between 860° C. with 680° C., admitting primary air from below said grate to said first, second, third and fourth zones through said grate in a controlled manner such that the combustion in said first and second zones is under-stoichiometric, admitting additional combustion air through the side walls to said first and second zones below said installation components and above said grate, said additional air being heated before entering said combustion chamber to a temperature corresponding to about the temperature in the respective zone of the combustion chamber to which said additional air is admitted, said waste material on said grate being burned by said combustion air and forming combustion gases which are conducted above said grate in the same direction as said waste material is moved on said grate around said installation components and then conducted above said installation components in a counter-current flow to the movement of said waste material being burned on said grate, while no additional air is supplied to the counter-current exhaust gas flow above said installation components.

2. A method according to claim 1, wherein said additional enveloping air has a temperature of between 500° C. and 720° C.

3. A method according to claim 1, wherein a volume ratio of said additional combustion air to primary air is ⅕ to ⅙.

4. An incineration apparatus including a combustion chamber having a grate on which waste material is moved through the combustion chamber, installation components disposed above said grate, side walls disposed at opposite sides of said grate and tightly receiving therebetween said installation components, said installation components forming an intermediate wall extending over the length of said grate and dividing said combustion chamber into a primary area between said grate and said intermediate wall and a secondary area between said intermediate wall and the top of said combustion chamber and forming at the end of said intermediate wall a flow reversal area for reversing the flow of the combustion gas flowing in said primary area in the same direction as the waste material on said grate and in said secondary area in the opposite direction, said side walls including cooling air passages and having, at least in some areas, between said primary area and said cooling air passages, a permeability for air such that air supplied to said cooling air passages can pass through said side walls into the respective primary combustion chamber areas.

5. An apparatus according to claim 4, wherein said areas of said side walls which are permeable for said cooling air each have a particular predetermined permeability.

6. An apparatus according to claim 5, wherein said permeability of said side wall areas is provided by passages additional other extending through the respective area of said side walls disposed between said air passages and the respective combustion chamber areas.

7. An apparatus according to claim 4, wherein said primary area of said combustion chamber includes first, second, third and fourth zones arranged adjacent one another in the direction in which the waste material is moved through the combustion chamber and wherein the areas of said side walls which are permeable are disposed mainly in said first and second zones.

8. An apparatus according to claim 4, wherein said intermediate wall consists of individual ceramic plates and said side walls have ledges on which said ceramic plates are supported.

9. An apparatus according to claim 8, wherein, in the direction in which the waste material is moved through the combustion chamber, the last of said individual ceramic plates in said fourth zone at the end of said grate as seen in the direction of movement of said waste material on said grate is inclined downwardly toward said grate.

* * * * *